United States Patent [19]

Gooding

[11] 4,354,283

[45] Oct. 19, 1982

[54] HEADBAND ASSEMBLY FOR PROTECTIVE HEADGEAR

[75] Inventor: Elwyn R. Gooding, Ann Arbor, Mich.

[73] Assignee: The Regents of the University of Michigan, Ann Arbor, Mich.

[21] Appl. No.: 216,245

[22] Filed: Dec. 15, 1980

[51] Int. Cl.[3] ..... A42B 3/02

[52] U.S. Cl. ..... 2/413

[58] Field of Search ..... 2/413, 411, 412, 414, 2/415, 416, 417, 410, 418, 419, 420, 6

[56] References Cited

U.S. PATENT DOCUMENTS

| | | | |
|---|---|---|---|
| 3,365,725 | 1/1968 | Webb | 2/413 |
| 3,462,763 | 8/1969 | Schneider et al. | 2/413 |
| 4,287,613 | 9/1981 | Schulz | 2/413 |

*Primary Examiner*—Doris L. Troutman

*Attorney, Agent, or Firm*—Olsen and Stephenson

[57] ABSTRACT

An energy-absorbing headband assembly to be worn with protective headgear. The headband assembly comprises a headband, a vertex pad, and a nape pad which coact to apply clamping pressure between the crown of the wearer's head and the back of the wearer's neck for securing the headband assembly in place and for absorbing and distributing forces within the headband assembly. The vertex pad may have multiple fluid-filled chambers and is held in position on the crown of the wearer's head by a flexible front support band fixed to the front of the headband. Nape bands are fixed to the sides of the headband and extend upward transversely to the vertex pad and extend downward and rearward to the nape pad to effect the clamping pressure.

12 Claims, 7 Drawing Figures

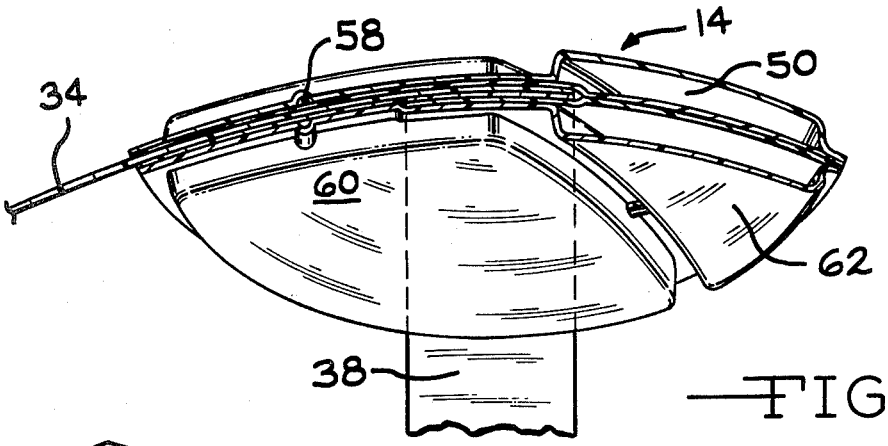
FIG. 3
FIG. 4
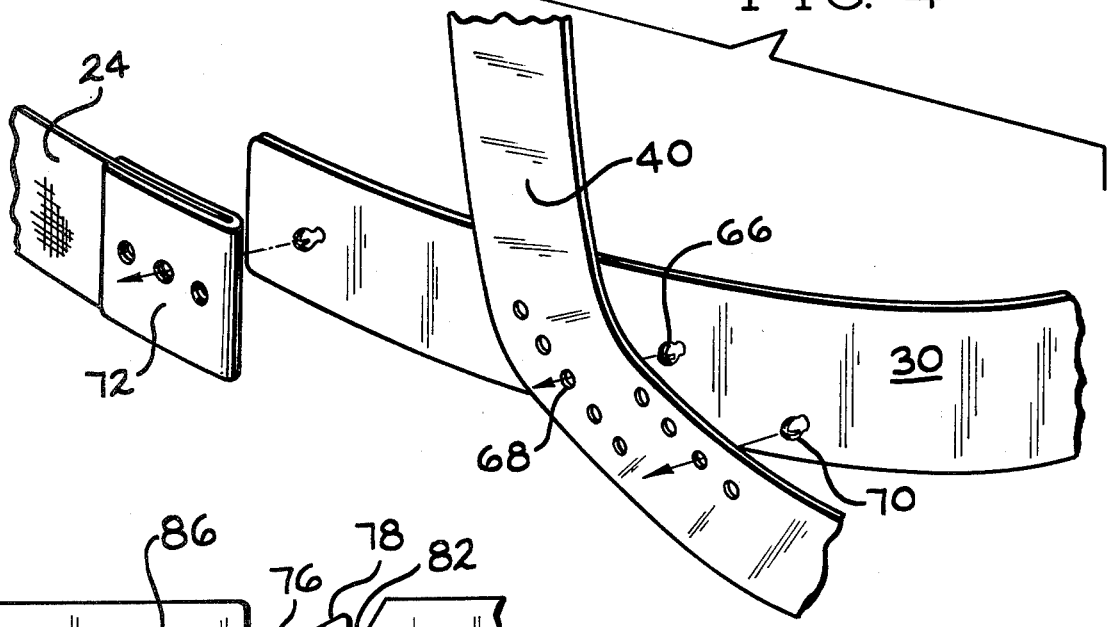
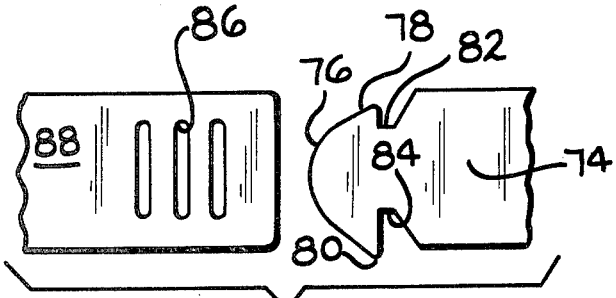
FIG. 5
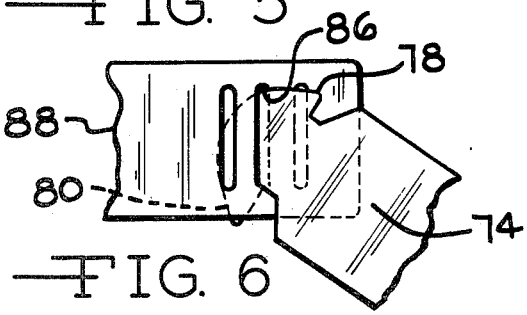
FIG. 6
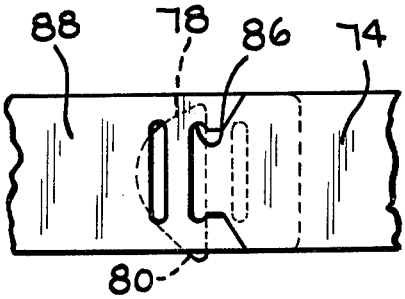
FIG. 7

HEADBAND ASSEMBLY FOR PROTECTIVE HEADGEAR

BACKGROUND OF THE INVENTION

The present invention relates to protective equipment, and, more particularly, to protective headgear.

In the past, a wide variety of protective headgear has been devised for use by participants in a number of sports, such as football, hockey, and baseball, and for use as crash helmets to protect a wearer's head in the event of a collision. Such headgear has ranged from simple cloth or leather head coverings with minimal padding to hard outer shells supported upon a network of straps. More recently, as developing technology has made possible the more accurate measurement of forces transmitted through protective headgear and has made available modern materials and techniques, significant improvements have been made with respect to the energy-absorbing characteristics of such headgear.

Consistent with the current state of the art, one of the preferred designs of protective headgear features a relatively hard outer helmet shell in conjunction with a flexible fluid-filled inner liner to support the helmet and dissipate forces applied thereto. However, as illustrated in applicant's U.S. Pat. No. 3,462,763, this current headgear design requires an impact-absorbing chin cup strapped to the wearer's chin to secure the helmet in place. Because the presence of such a chin strap results in substantial wearer discomfort and inconvenience, such helmets have been adopted only in the most vigorous contact sports and in situtations having unusually high risk of collision. In moderate risk situtations, such as in passenger cars and in industrial "hard hat" areas, either no protective headgear or less substantial protective headgear has been preferred, largely due to the interference of the chin strap with the wearer's activity.

To applicant's knowledge, there has been no apparatus devised for use with modern protective headgear which eliminates the need for a chin strap. Applicant is aware of rudimentary nape straps which have been worn with various decorative or sun-shielding hats, as illustrated by early military campaign hats, which have been used in place of traditional chin straps. However, such rudimentary nape straps are clearly inadequate to secure modern protective headgear in place and to absorb and distribute forces applied to the protective headgear. It is, therefore, an object of the present invention to provide an energy-absorbing headband assembly for modern protective headgear which eliminates the need for a chin strap.

SUMMARY OF THE INVENTION

The present invention is an energy-absorbing headband assembly to be worn between protective headgear and a wearer's head.

The headband assembly comprises a headband, a vertex pad, and a nape pad which coact to apply clamping pressure between the crown of the wearer's head and the back of the wearer's neck for securing the headband assembly in place and for absorbing and distributing forces within the headband assembly. The headband flexibly encircles the wearer's head from forehead to occiput and may include mounting clips engageable with the protective headgear. The vertex pad has multiple fluid-filled chambers and is held in position on the crown of the wearer's head by a flexible front support band fixed to the front of the headband and by right and left nape bands which are fixed to the sides of the headband and extend transversely along the wearer's head. The nape bands extend downward and rearward from the sides of the headband to secure the nape pad in place and apply the desired clamping pressure.

The present invention provides a headband assembly having a unique clamping action between the multi-chambered fluid-filled vertex pad at the crown of the wearer's head and the nape pad which conforms to the lower part of the wearer's head adjacent the wearer's neck. Unlike the rudimentary nape straps of the prior art, the present invention utilizes nape bands which extend above the headband to the vertex pad and a front support band which joins the vertex pad to the front of the headband. This particular geometry reduces the tendency of the nape bands to slide upward toward the headband allowing the attached headgear to become dislodged from the wearer's head, a problem which would result with the prior art designs. The nape bands and headband side portions of the present invention may be made of resilient non-stretchable sheet material and the nape bands can be made in dogleg configuration so as to resist buckling and increase the clamping action of the headband assembly.

Additional features may be incorporated in the headband assembly. More specifically, the headband may include elastic web panels, and the various bands of the headband assembly may be sufficiently adjustable to permit use of a single headband assembly by wearers having different head sizes and shapes. Further, the vertex pad may be formed of two separate generally horizontal fluid-filled cushions bonded together in back-to-back relationship, each cushion consisting of multiple fluid-filled chambers with interconnecting passages having predetermined cross section so as to control the flow of fluid between the chambers. This dual vertex pad configuration increases wearer comfort and provides a measure of energy-absorbing capability in the event of a rupture and facilitates the fixing of the front support band and nape bands to the vertex pad.

Further objects and features of the invention will become more fully apparent from the following description of the preferred embodiment of this invention and from the appended claims.

BRIEF DESCRIPTION OF THE DRAWINGS

FIG. 3 is a cross sectional view of the fluid-filled vertex pad of the present invention taken along the line 3—3 of FIG. 2;

FIG. 4 is an exploded view of a preferred means of fixing the nape bands to the headband side portions and for joining the elastic web portions of the headband to the headband assembly;

FIG. 5 is a plan view of an alternative adjustable two-piece construction of the front support band and nape bands showing two mating intermediate ends of a band in unassembled relation;

FIG. 6 is a plan view of the intermediate ends of the band of FIG. 5 when pivoted into partially assembled relationship; and FIG. 7 is a plan view of the intermediate ends of the band of FIG. 5 shown rotated into fully assembled relationship.

DESCRIPTION OF THE PREFERRED EMBODIMENT

Figure 1:
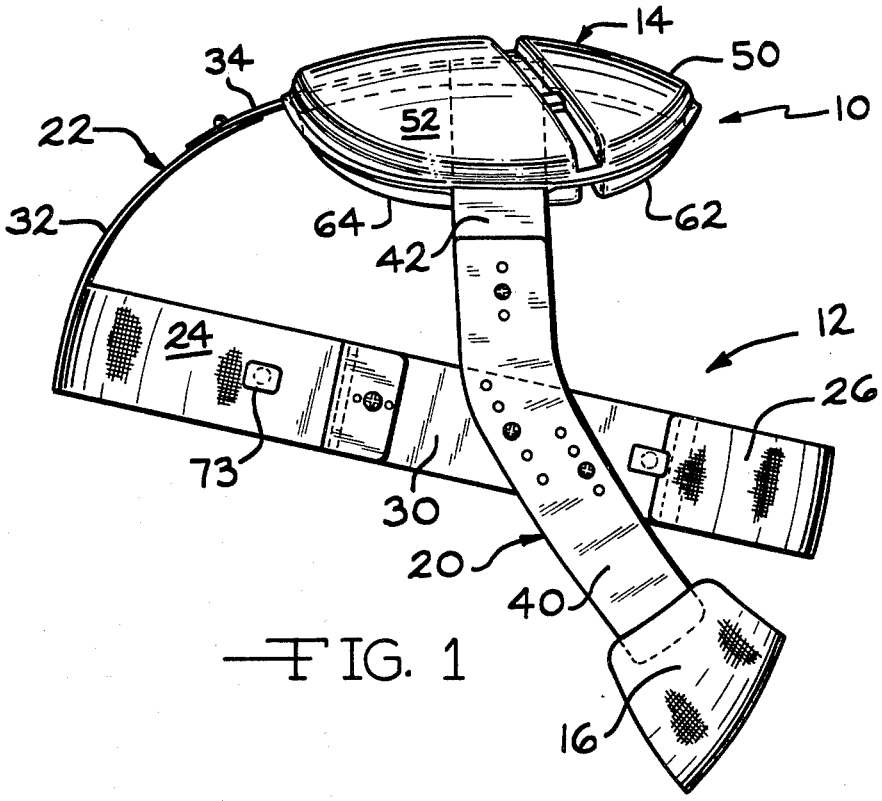
FIG. 1 is a side elevational view of the energy-absorbing headband assembly of the present invention.
Figure 2:
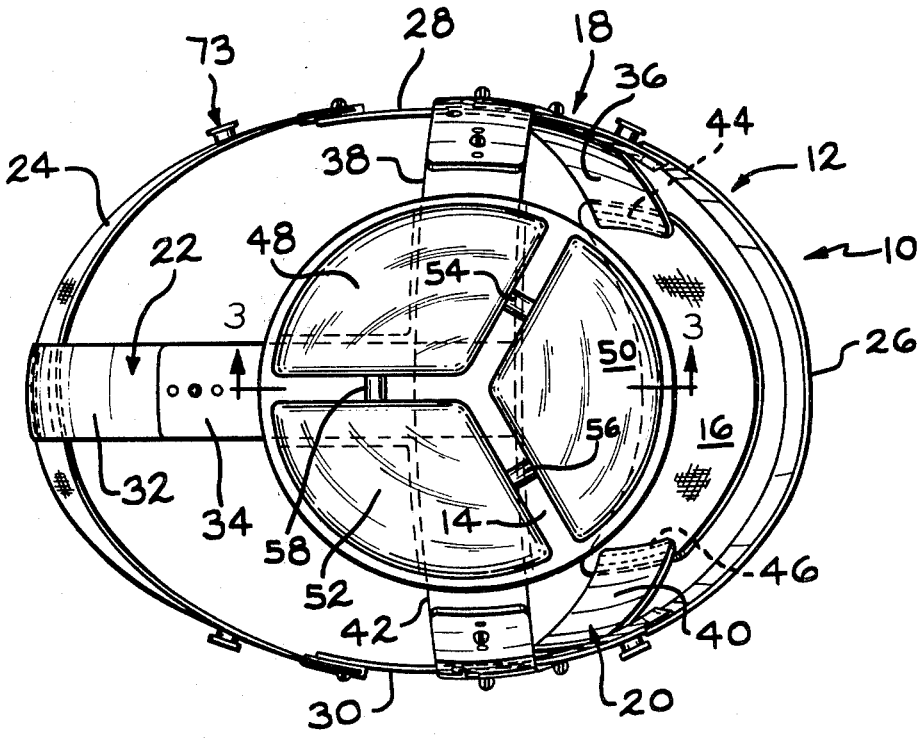
FIG. 2 is a plan view of the energy-absorbing headband assembly of FIG. 1.

With reference to the drawing, the preferred embodiment of the energy-absorbing headband assembly of the present invention is illustrated in FIGS. 1 and 2, indicated generally at 10. A flexible headband, indicated generally at 12, interacts with a fluid-filled vertex pad 14 and a nape pad 16 to apply clamping pressure between the crown of the wearer's head and the back of the wearer's neck. Right and left nape bands, indicated generally at 18 and 20, and a flexible front support band, indicated generally at 22, support the vertex pad 14 and nape pad 16 in position with respect to the headband 12.

The headband 12 includes an elastic web front portion 24 and an elastic web rear portion 26 made of doubleknit nylon or other similar material for biasing the headband into contact with the wearer's head and for permitting breathing of the wearer's skin through the headband. The headband 12 has right and left side portions 28 and 30 of resilient non-stretchable sheet material such as polypropylene so as to provide a rigid surface for the affixing of the right and left nape bands 18 and 20. The front support band 22 is made of a resilient flexible material such as polypropylene and is formed of overlapping lower and upper sections 32 and 34 so as to provide shortening and lengthening of the front support band 22. Similarly, the right nape band 18 is formed of overlapping lower and upper sections 36 and 38, and the left nape band is formed of overlapping lower and upper sections 40 and 42.

The headband 12 is positionable upon a wearer's head in the traditional manner with the front portion 24 contacting the wearer's forehead, the rear portion 26 contacting the wearer's occiput, and the right and left side portions 28 and 30 contacting the sides of the wearer's head. The front support band 22 is fixed by stitching at one end thereof to the center of the headband front portion 24 and extends arcuately upward and rearward along the surface of the wearer's head. The front support band 22 terminates at the fluid-filled vertex pad 14 to which it is fixed by dielectric bonding. The right and left nape bands 18 and 20 are fixed by stitching to the right and left ends of the nape pad 16 at 44 and 46 and extend upward and forward along the surface of the wearer's head to the fluid-filled vertex pad 14 to which they are fixed by dielectric bonding.

The right and left nape bands 38 and 40 are rigidly fixed to the right and left headband side portions 28 and 30 by attaching means which is adjustable to permit raising and lowering of the vertex pad 14 with respect to the headband 12. As illustrated in FIG. 1, the right and left nape bands 38 and 40 have dogleg configurations such that the intersections of the headband 12 with the nape bands 38 and 40 are offset forward and below a plane intersecting the ends of the nape bands 18 and 20. This offset ensures that the nape bands 18 and 20 form transverse members to more directly clamp the vertex pad 14 against the crown of the wearer's head. This geometry reduces any tendency of the vertex pad 14 and the nape pad 16 to slide toward each other along the surface of the wearer's head as would result if the nape bands were straight or if they were pivotally mounted upon the headband.

The fluid-filled vertex pad 14 has a round upper cushion comprising three equal pie-shaped fluid-filled chambers 48, 50, and 52 which are interconnected by fluid-carrying passages 54, 56, and 58 and a round lower cushion similarly formed with three equal pie-shaped fluid-filled chambers 60, 62, and 64 which are interconnected by fluid-carrying passages. As shown in FIG. 3, the front support band 22 and nape bands 18 and 20 are dielectrically bonded together between the upper and lower cushions of the vertex pad 14 to which they are dielectrically bonded. The fluid-carrying passages 54, 56, and 58 of the upper cushion and those of the lower cushion are of predetermined cross section to control the flow of fluid between the chambers so as to laterally disperse forces which are applied to the protective headgear. The fluid-filled chambers and fluid-carrying passages are formed by molding or vacuum forming of polyurethane or a blend of vinyl-polyurethane and are prefilled with fluid when they are sealed by dielectric bonding. Applicant has found that air is a suitable fluid for filling the chambers and passages.

As shown in FIG. 4, resiliently deformable studs such as 66 may be used to join the sections of the headband 12, to adjustably join the overlapping sections of the front support band 22 and the nape bands 18 and 20, and to provide the adjustable and yet rigid fixing of the nape bands to the headband side portions 28 and 30. The studs may be formed of resilient material such as a suitable plastic with a spherical head portion and relief slots to facilitate penetration by the stud head of a round opening 68 in a mating band surface. The round opening 68 is of a diameter smaller than the head of the stud 66 so as to present an interference fit and lock the two bands together by the expansion of the head of the stud 66 after penetrating the round opening 68. A single such stud is sufficient for the joining of the two-piece construction of the front support band 22 and the nape bands 18 and 20 and for the securing of the headband front portion 24 to each of the headband side portions 28 and 30. A second stud 70 is required for the rigid fixing of the headband side portions 28 and 30 to the right and left nape bands 38 and 40. A series of spaced round openings 68, each engageable with the stud 66, is used to provide the adjustments previously described.

The headband front portion 24, which is made of an elastic web, is wrapped with a polypropylene sheet 72 which is stitched thereto, as shown in FIG. 4. The polypropylene sheet 72 tends to stabilize the shape of the ends of the headband front portion 24 and permits the use of studs to adjustably join the headband front portion 24 to the headband side portions 28 and 30. A plurality of mounting clips 73 may be spaced along the outside surface of the headband 12 for mounting the headband assembly 10 to the protective headgear under which the headband assembly is worn. The mounting clips 73, which may be releasable snaps, are directed away from the surface of the wearer's head, as indicated generally in FIGS. 1 and 2.

An alternative means of adjustably joining the overlapping ends of the bands of the headband assembly 10 is shown in FIGS. 5–7. One of the two overlapping straps, here indicated as 74, terminates in a rounded tip 76 having transversely projecting side tabs 78 and 80 formed at opposite edges of the band 74 by transverse notches 82 and 84. The tabs 78 and 80 are engageable with a selected slot 86 in a mating band 88 by first inserting the tab 80 into the slot 86 as shown in FIG. 6 while band 74 is positioned at an angle to the band 88. The band 74 is then pivoted into alignment with the band 88, thereby bringing the tab 78 into engageable relationship with the slot 86. When the band 74 is centered with respect to the band 88 as shown in FIG. 7, the tabs 78 and 80 engage the ends of the slot 86 to prevent relative longitudinal movement between the bands 74 and 88. To increase the surface area of tabs 78 and 80 which is engageable with the slot 86, tab 80 may be made larger than tab 78, as shown.

It will be seen from the foregoing description of the preferred embodiment that the present invention provides an energy-absorbing headband assembly which is suitable for protective headgear and which does not require the use of a chin strap and chin cup. Accordingly, the headband assembly of the present invention is more comfortable, convenient, and versatile than the headband assemblies of protective headgear previously utilized. While the preferred embodiment has been described in considerable detail, the present invention is not limited to such detail except as may be necessitated by the appended claims.

What is claimed is:

1. An energy-absorbing headband assembly to be worn between protective headgear and a wearer's head comprising:

a flexible headband having a front portion positionable upon the wearer's forehead, a rear portion positionable upon the occiput of the wearer, and right and left side portions connecting said front and rear portions so as to contact the wearer's head and complete a perimeter about the wearer's head;

a multichambered fluid-filled vertex pad positionable upon the crown of the wearer's head forming a yieldable and resilient cushion thereon;

a flexible front support band connecting said vertex pad to said headband front portion so as to locate the vertex pad above and behind the headband front portion;

a resilient and yieldable nape pad positionable upon the wearer's nape and conformable to the lower part of the wearer's head;

a right nape band having ends fixed to said vertex pad and said nape pad and having an intermediate portion fixed to said headband right side portion at the intersection of said right side nape band and said headband right side portion; and a left nape band having ends fixed to said vertex pad and said nape pad and having an intermediate portion fixed to said headband left side portion at the intersection of said left nape band and said headband left side portion;

said headband, front support band, right nape band, and left nape band coacting with said vertex pad and said nape pad so as to apply clamping pressure between the crown of the wearer's head and the wearer's nape for securing the headband assembly in place and for absorbing and distributing forces within the headband assembly.

2. A headband assembly as defined in claim 1 wherein the headband, front support band, right nape band, and left nape band include sufficient adjustable means to change the length of said bands and alter said intersections of the nape bands and the headband side portions so as to enable the headband assembly to fit wearers having different head sizes and shapes.

3. A headband assembly as defined in claim 2 wherein at least one of said bands is of two-piece construction having overlapping end portions and wherein said adjustable means includes at least one stud in one said end portion and means forming a plurality of longitudinally spaced openings in said other end portion, said stud being resiliently deformable into a selected one of said plurality of openings so as to join said overlapping end portions and restain relative longitudinal movement between said ends.

4. A headband assembly as defined in claim 2 wherein at least one of said bands is of two-piece construction having overlapping end portions and wherein said adjustable means includes means forming longitudinally spaced transverse slots in one of said end portions and opposing transversely extending tabs on said other end, said tabs being positionable into a selected one of said slots so as to engage the ends of said selected slot to join said end portions and restrain relative longitudinal movement between said ends.

5. A headband assembly as defined in claim 4 wherein one of said opposing transversely extending tabs is larger than said other tab so as to increase the surface area of said tabs engageable with the ends of said selected slot when said larger tab is first inserted in said selected slot, said smaller tab is then pivoted through said slot, and said transversely extending tabs are then centered in engaging relationship to said selected slot.

6. A headband assembly as defined in claim 1 wherein at least a portion of said flexible headband includes elastic web means for biasing said headband into contact with the wearer's head so as to hold the headband assembly in place and for permitting breathing of the wearer's skin through the headband to increase wearer comfort.

7. A headband assembly as defined in claim 1 wherein said multichambered fluid-filled vertex pad comprises:

an upper cushion having a plurality of fluid-filled upper chambers interconnected by fluid carrying passages of predetermined cross section so as to control the flow of fluid between said upper chambers and a lower cushion having a plurality of fluid-filled lower chambers interconnected by fluid carrying passages of predetermined cross section so as to control the flow of fluid between said lower chambers, said upper and lower chambers and said fluid carrying passages having resilient wall means bonded together so as to seal a fluid within said upper and lower cushions and fluid carrying passages.

8. A headband assembly as defined in claim 1 wherein said right and left nape bands and said headband side portions are made of resilient non-stretchable sheet material so as to resist buckling and wherein said intersections of said nape bands and headband side portions are forward of and below a plane intersecting the ends of said nape bands, said nape bands having dogleg configurations so as to extend transversely from said vertex pad to said headband side portions and decrease any tendancy of the vertex and nape pads to slide toward each other along the surface of the wearer's head rather than clamp against the wearer's head.

9. A headband assembly as defined in claim 8 wherein said nape bands and said headband side portions are made of polyproplyene.

10. A headband assembly as defined in claim 1 wherein said multichambered fluid-filled vertex pad is filled with air.

11. A headband assembly as defined in claim 1 wherein said right and left nape bands and said front support band are joined together adjacent said vertex pad.

12. A headband assembly as defined in claim 1 which further comprises a plurality of mounting clips fixed to said flexible headband which are engageable with the protective headgear so as to secure the headband assembly to the protective headgear.

* * * * *